US006641171B2

(12) United States Patent
Lin et al.

(10) Patent No.: US 6,641,171 B2
(45) Date of Patent: Nov. 4, 2003

(54) STRUCTURE OF A FILE WITH ADJUSTABLE INCLINATION ANGLE

(76) Inventors: Chyun-Chau Lin, PO Box 82-144, Taipei (TW); Chien-Hsun Wu, PO Box 82-144, Taipei (TW)

( * ) Notice: Subject to any disclaimer, the term of this patent is extended or adjusted under 35 U.S.C. 154(b) by 0 days.

(21) Appl. No.: 10/022,547

(22) Filed: Dec. 20, 2001

(65) Prior Publication Data

US 2003/0042729 A1 Mar. 6, 2003

(30) Foreign Application Priority Data

Aug. 29, 2001 (TW) ..... 90214812 U

(51) Int. Cl.[7] ..... B42D 3/00

(52) U.S. Cl. ..... 281/33; 229/67.1; 248/441.1; 248/460; 281/29; 281/45; 493/947

(58) Field of Search ..... 281/29, 36, 37, 281/33, 15.1, 45; 248/447, 441.1, 445, 454, 455, 457, 460; D19/75, 86; 493/947; 229/67.1

(56) References Cited

U.S. PATENT DOCUMENTS 3,747,889 A * 7/1973 Gerald ..... 248/451
D264,095 S * 4/1982 Smith ..... D19/27
4,355,821 A * 10/1982 Crawford ..... 281/33
4,377,271 A * 3/1983 Smith ..... 248/460
4,456,286 A * 6/1984 Jamar ..... 281/44
4,609,206 A * 9/1986 O'Brien ..... 281/33
4,886,231 A * 12/1989 Doerksen ..... 248/455
5,251,935 A * 10/1993 Bottiglieri ..... 281/45
6,234,533 B1 * 5/2001 Torimoto ..... 281/33
2003/0042728 A1 * 3/2003 Lin et al. ..... 281/33
2003/0042729 A1 * 3/2003 Lin et al. ..... 281/33

* cited by examiner

*Primary Examiner*—Monica Carter
(74) *Attorney, Agent, or Firm*—Leong C. Lei

(57) ABSTRACT

This invention relates to a file structure in which the inclination angle thereof is adjustable. The structure comprises (a) an inner covering board having a rear center; (b) an outer covering board mounted to the upper section of the inner covering board at one surface thereof and a scored line being formed across the outer covering board so that the outer covering board can be inclined at an angle with respect to the inner covering board, the bottom edge of the outer covering board being provided with a plurality of fixing holes; (c) a pair of chains having a stop at both ends and one of the stops being fastened to the lower section of the inner covering board and the other stop being mounted to the fixing holes at the lower section of the outer covering board, thereby when the outer covering board is extended with an inclination angle, the chain is touted by the weight of the file and the file is stood in a stable inclined position.

3 Claims, 8 Drawing Sheets

STRUCTURE OF A FILE WITH ADJUSTABLE INCLINATION ANGLE

BACKGROUND OF THE INVENTION (a) Field of the Invention

The present invention relates to a structure of a file, and in particular, the file can be placed in an upright position and the angle of inclination of the file can be adjusted.

(b) Description of the Prior Art

Conventional file for documentation is normally placed horizontally and cannot be placed in an upright position and the inclination angle cannot be adjusted. This is not convenient in application when documents kept in the file are needed while using the computer. One of the hands is needed to hold the file so that the filed documents are in a position, which can be read by the user. In this case, the user can have only one hand to use the computer, while the other hand is used to hold the file. Accordingly, it is the object of the present invention to provide an improved structure of a file, which stands in an upright position, and the inclination angle of the file can be adjusted, facilitating the documentation of file and usage of the filed documents.

SUMMARY OF THE INVENTION

Accordingly, it is an object of the present invention to provide a structure of a file with adjustable inclination angle, wherein the file can stand with an inclined angle.

A further object of the present invention is to provide a structure of a file with adjustable inclination angle, wherein the rear center of the outer covering board is provided with a flexural section.

Yet a further object of the present invention is to provide a structure of a file with adjustable inclination angle, wherein the inner covering board is provided with a flexural section.

An aspect of the present invention is to provide a structure of a file with adjustable inclination angle, wherein the structure comprises (a) an inner covering board having a rear center; (b) an outer covering board mounted to the upper section of the inner covering board at one surface thereof and a scored line being formed across the outer covering board so that the outer covering board can be inclined at an angle with respect to the inner covering board, the bottom edge of the outer covering board being provided with a plurality of fixing holes; (c) a pair of chain having a stop at both ends and one of the stop being fastened to the lower section of the inner covering board and the other stop being mounted to the fixing holes at the lower section of the outer covering board, thereby when the outer covering board is extended with an inclination angle, the chain is touted by the weigh of the file and the file is stood in a stable inclined position.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PRESENT INVENTION

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
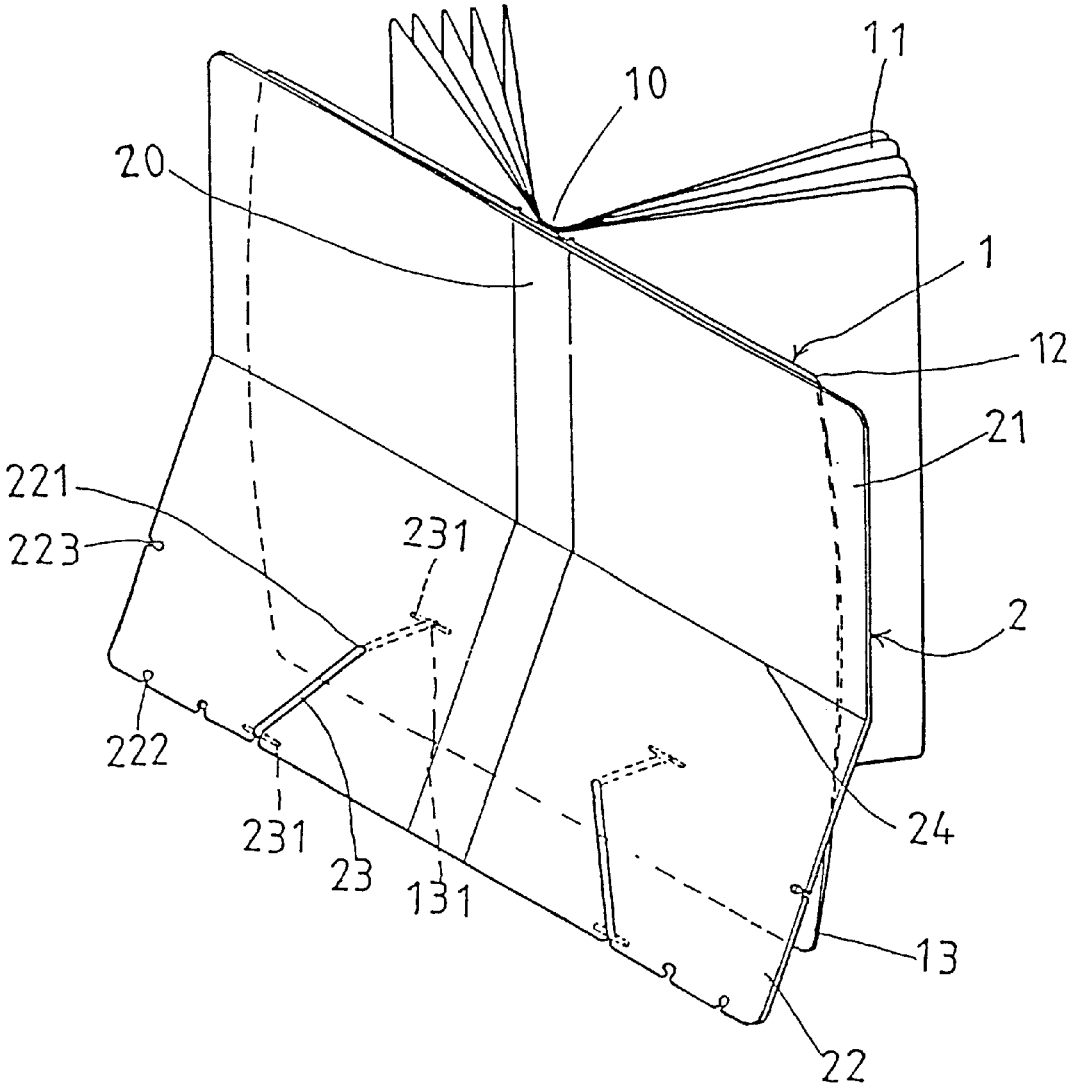
FIG. 1 is a perspective view of a structure of a file with adjustable inclination angle in accordance with the present invention.

Referring to FIG. 1, there is shown a structure of a file with adjustable inclination angle comprising (a) an inner covering board 1 containing a plurality of inner pages 11 at the external surface thereof and a back center 10, (b) an outer covering board 2 having a back center and being mounted to the inner surface of the inner covering board 1, characterized in that a scored line 24 is provided across the outer covering board 2 such that the lower section 22 of the outer covering board 2 can be inclined outward to form a sloping position, and a pair of chains 23 having a stop 231 are mounted at one of the holes 222 along the bottom edge of the outer covering board 2, or the hole 223 at the lateral side of the outer covering board 2 so that the sloping of file is fixed and one end of the chain 23 is position at an appropriate position at the lower section 13 of the inner covering board 1.

Figure 5:
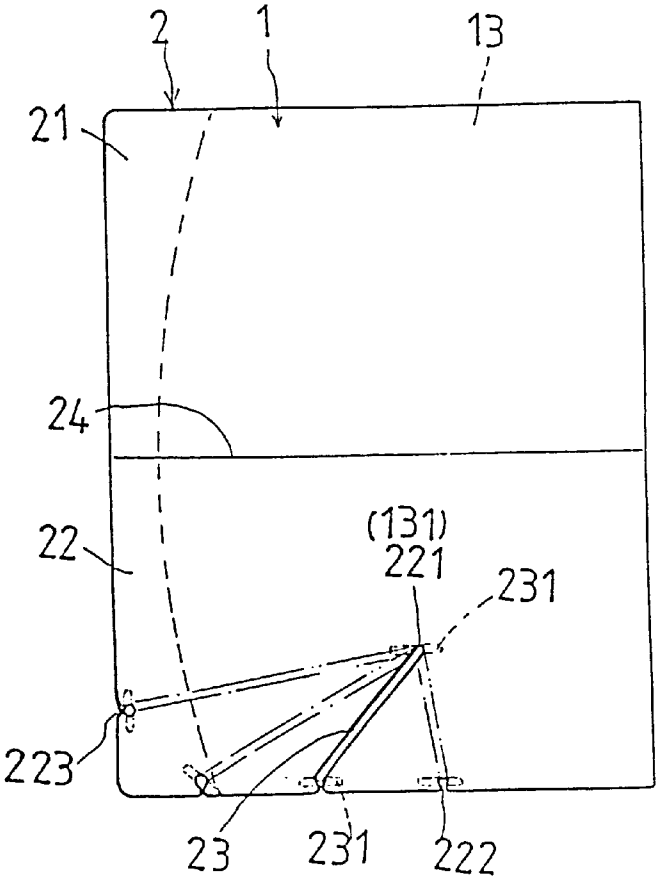
FIG. 5 is another schematic view showing the adjustment of the inclination angle of a structure of a file with adjustable inclination angle, in accordance with the present invention.
Figure 4:
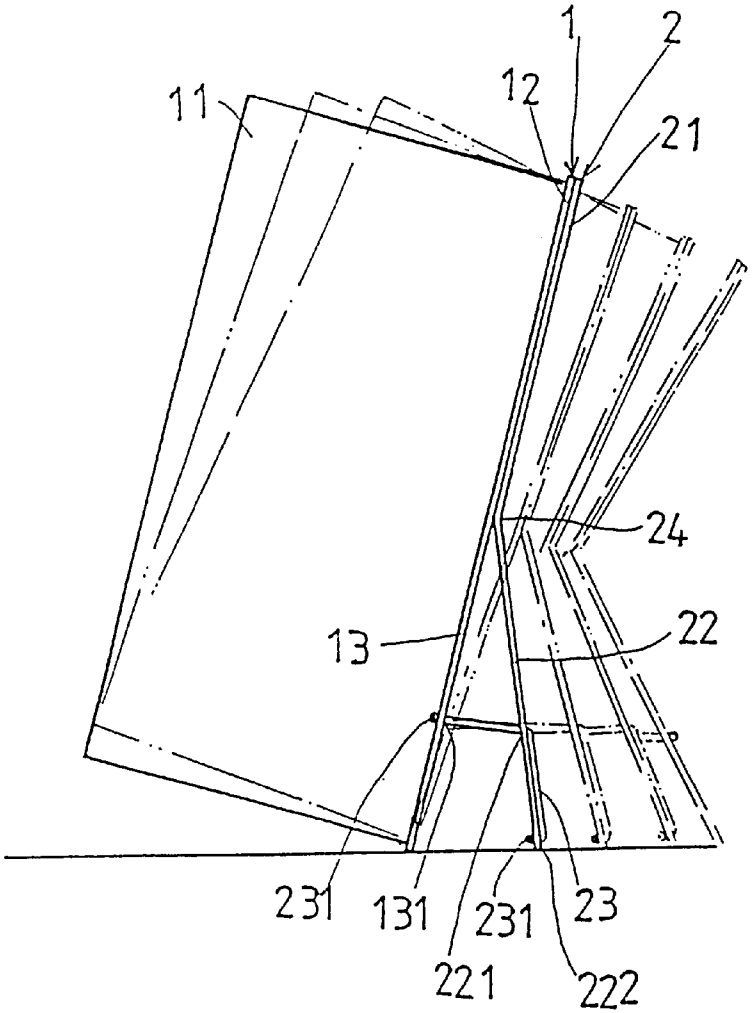
FIG. 4 is a schematic view showing the adjustment of the inclination angle of a structure of a file with adjustable inclination angle, in accordance with the present invention.

Referring to FIGS. 4 and 5, due to the fact that the length of the chain 23 is fixed, when the distance between the lower sections 13 and 22, the angle of inclination of the inner covering board 1 and the outer covering angle 2 changes. When the step 231 is far away from the fixing hole 221, the width of the lower sections 13, 22 is narrower, and the chain 23 is long, the angle of inclination is small. When he stop 231 is at the fixing hole 221 of the outer covering board 2, the angle of inclination is the largest. When the stop 231 is at the fixing hole 223 at the edge of the outer covering board 2, the distance between the lower sections 13, 22 is the smallest and thus the inner and outer covering boards 1, 2 can be folded. Due to the weight of the file, the chains 23 is touted and the file is stable to stand with an inclination angle. Thus, the user can adjust the angle of inclination of the file in accordance to his requirements.

Figure 2:
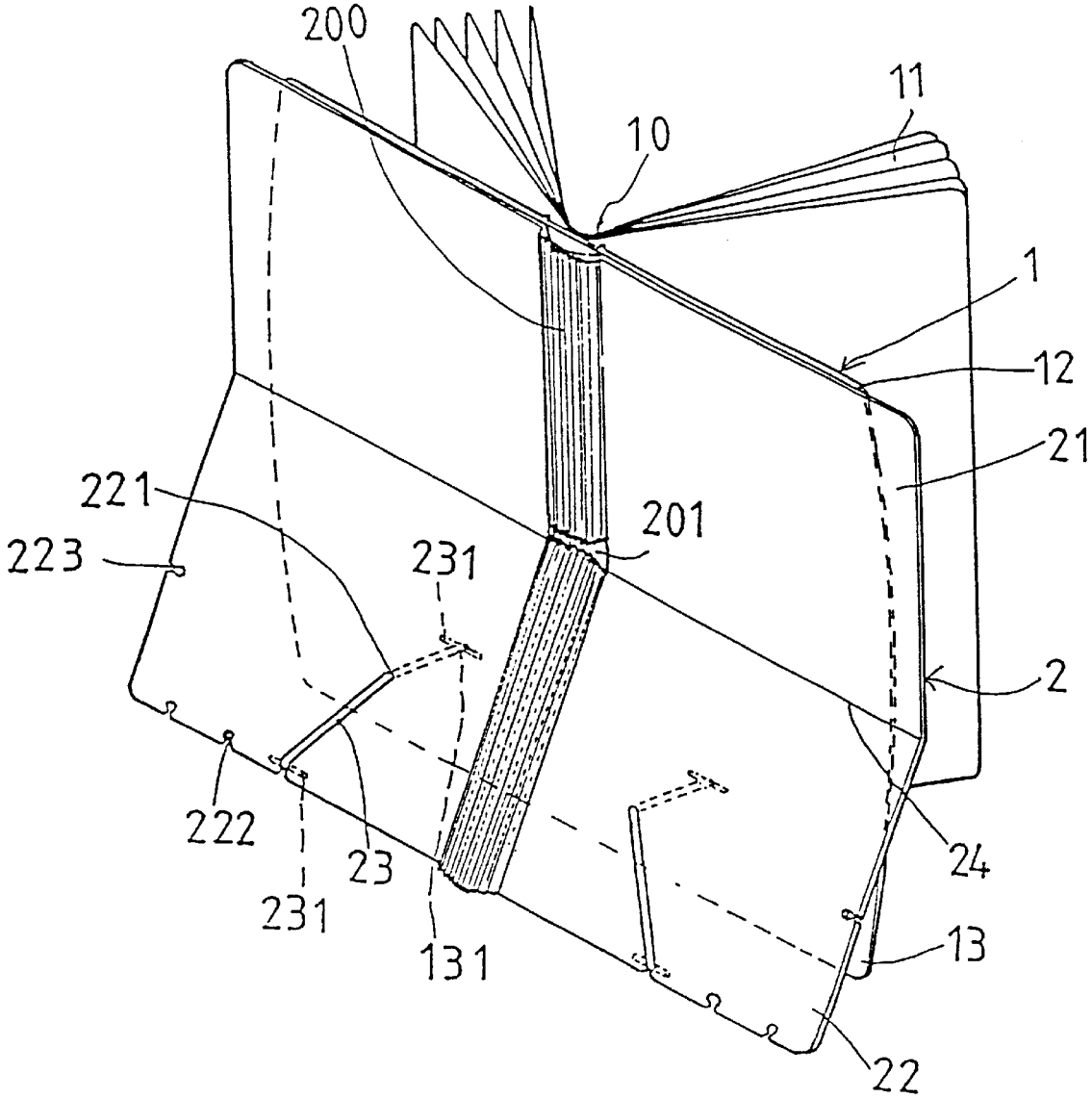
FIG. 2 is a perspective view of a structure of a file with adjustable inclination angle, in accordance with the present invention, wherein a flexural section is mounted at the rear center of the outer covering board.
Figure 3:
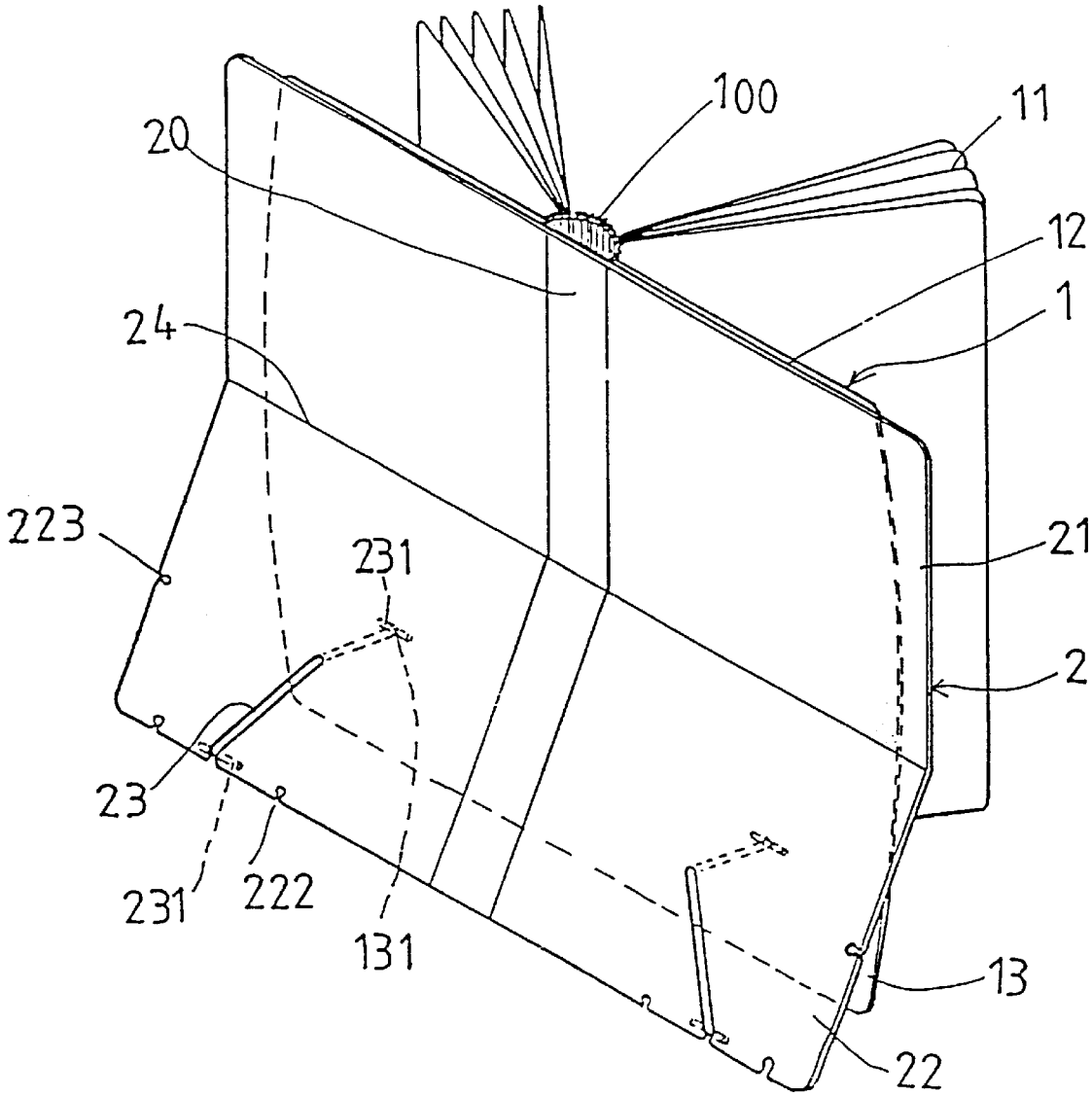
FIG. 3 is a perspective view of a structure of a file with adjustable inclination angle, in accordance with the present invention, wherein the flexural section is mounted at the rear center of the inner covering board.

Referring to FIG. 2, the rear center 20 of the outer covering board 2 has a flexural section 200, and there is a through hole 201 at center of the flexural section 200, the inclination action of the file will not be affected. FIG. 3 shows the inner covering board 1 with a flexural section 100 at the rear center 10 of the inner covering board 1, facilitating the bending of the inner covering board 1.

Figure 6:
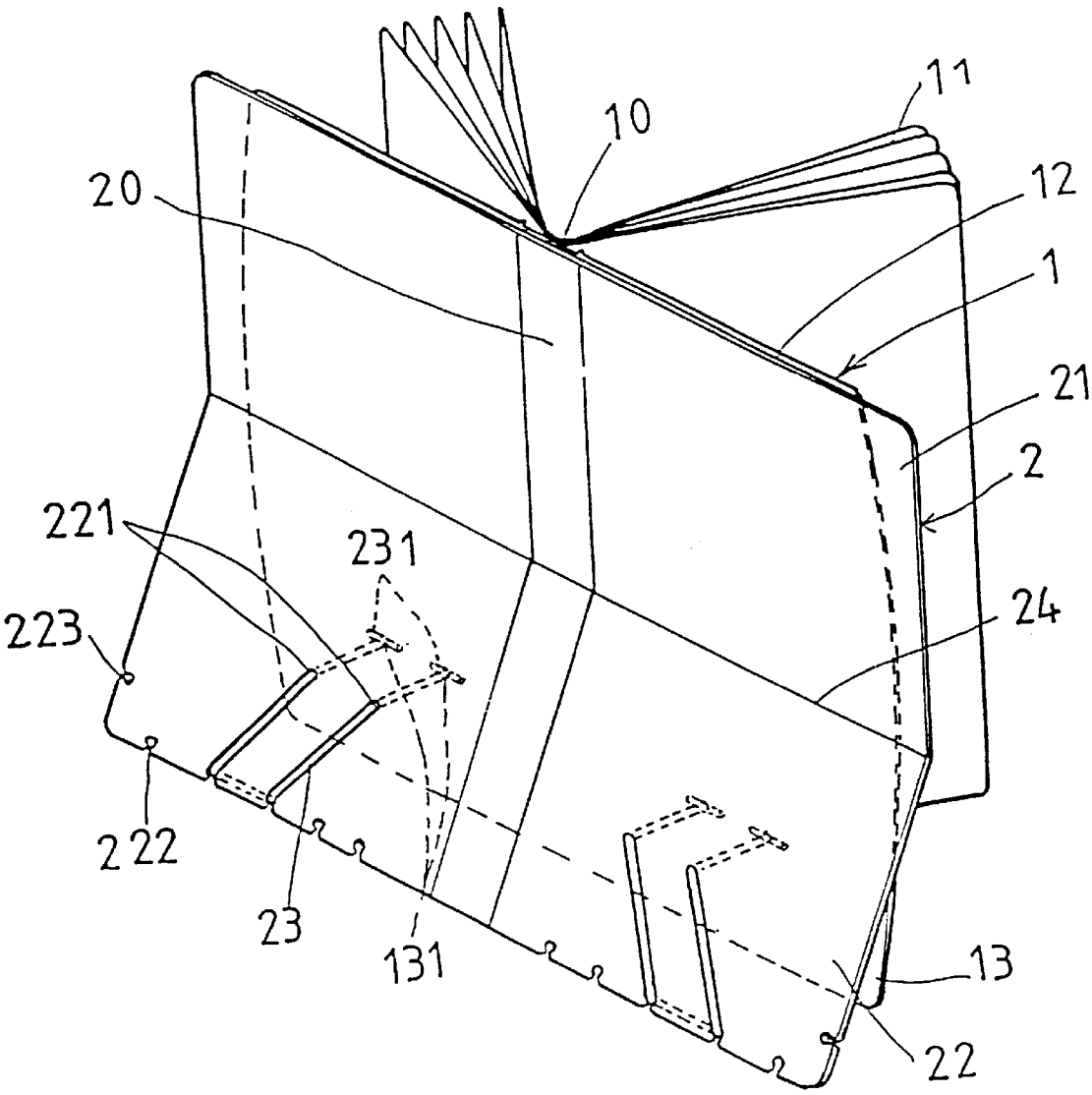
FIG. 6 is a perspective view of a structure of a file with adjustable inclination angle, of another preferred embodiment in accordance with the present invention.
Figure 7:
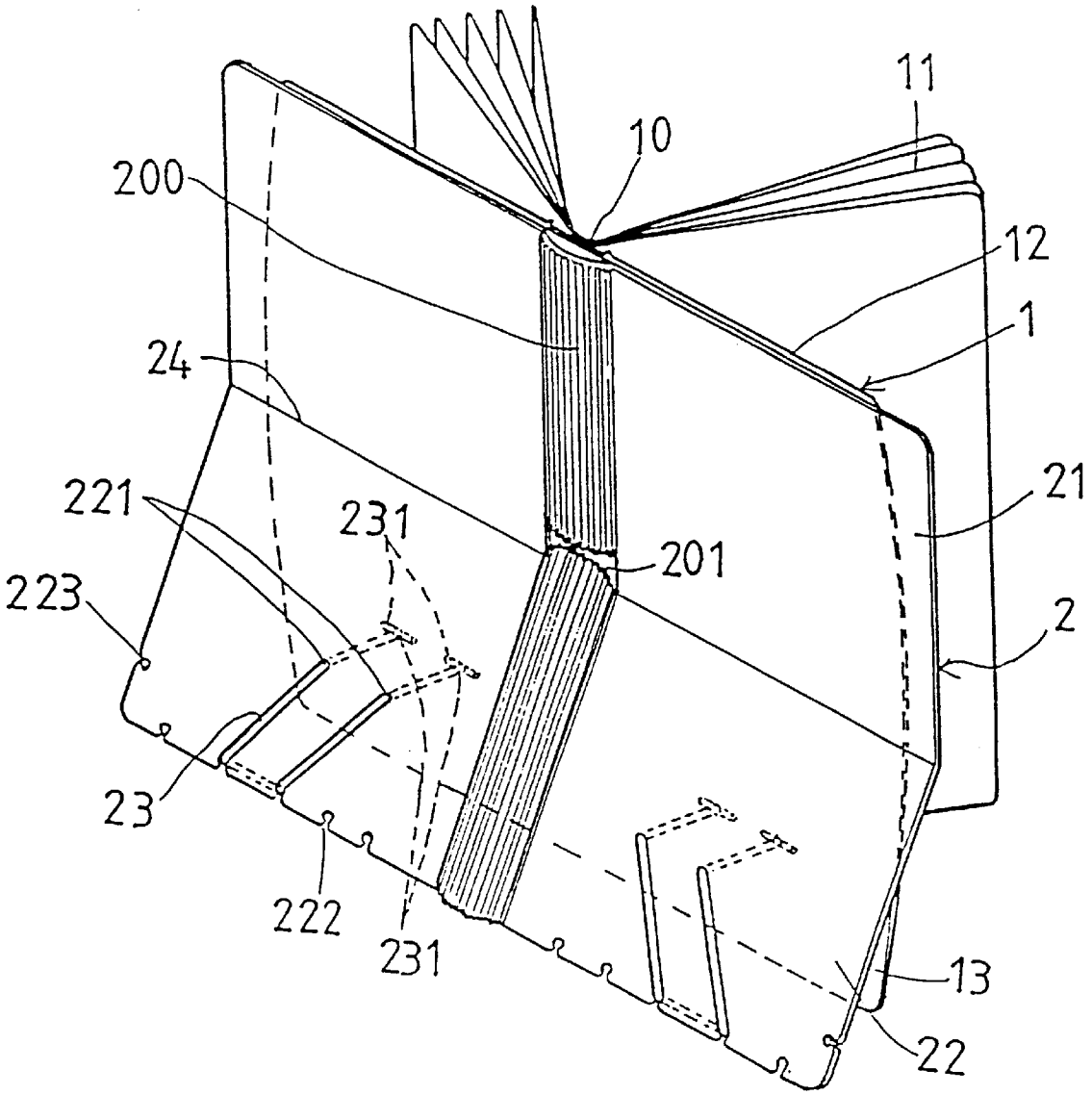
FIG. 7 is a perspective view, showing the rear center of the outer covering board of FIG. 6 being mounted with a flexural section in accordance with the present invention.
Figure 8:
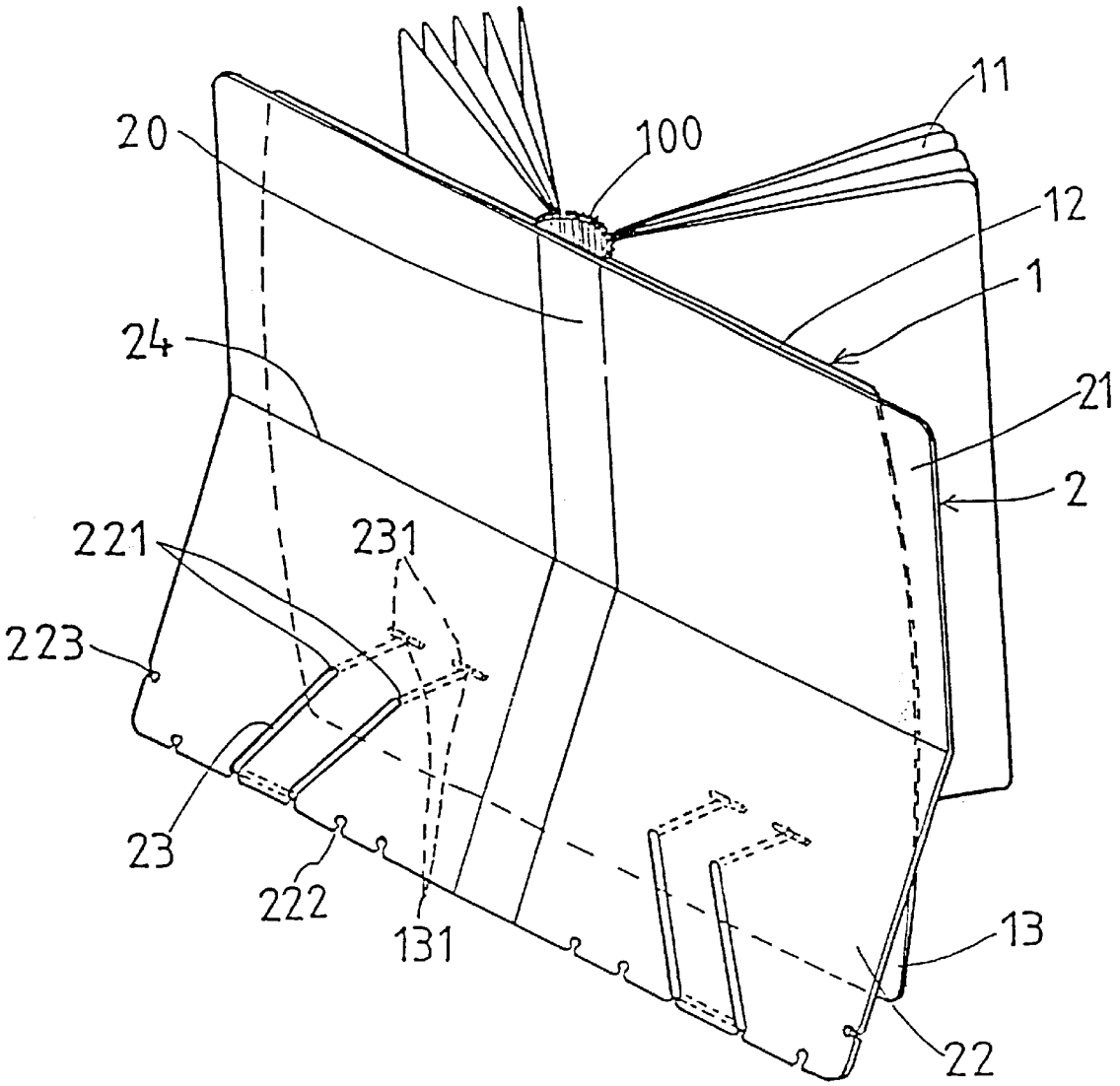
FIG. 8 is a perspective view, showing the inner covering board of FIG. 6 being mounted with a flexural section in accordance with the present invention.

FIG. 6 is a perspective view of another preferred embodiment of a structure of a file with adjustable inclination angle, in accordance with the present invention. In this preferred embodiment, the fixing holes 222 are made in pair along the bottom edge of the outer covering board 2, and the stop 231 at the two ends of the chain 23 is mounted at the lower section 13 of the inner covering board 1. As the chain 23 has a "V" shaped middle section, the section can be positioned with the fixing holes 222. As shown in FIG. 8, the back center of the inner covering board 1 is provided with a flexural section 100 (as shown in FIG. 8).

Figure 10:
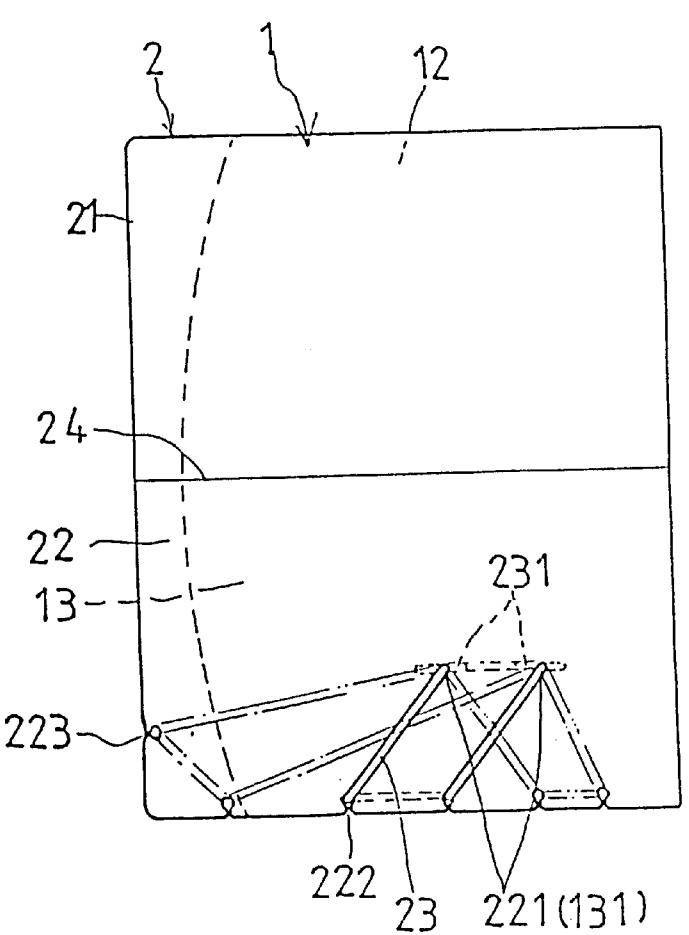
FIG. 10 is a perspective view of a structure of a file with adjustable inclination angle, of another preferred embodiment in accordance with the present invention.
Figure 9:
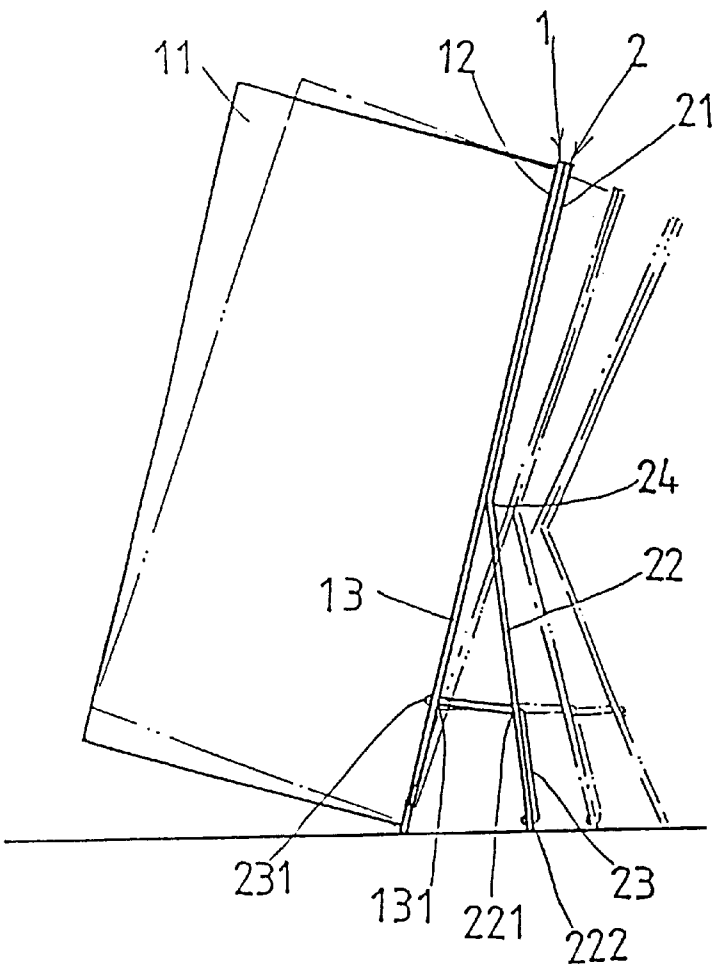
FIG. 9 is another schematic view showing the adjustment of the inclination angle of a structure of a file with adjustable inclination angle, in accordance with the present invention.

Referring to FIGS. 9 and 10, there is shown the adjustment of inclination angle of the file shown in FIG. 8. The chain 23 is fastened at the fixing holes 222. When the fixing holes 222 closer to the rear center 20, the angle of inclination is larger as the distance between the lower sections 13, 22 is larger. When the fixing holes 222 are closer to the lateral edge, the distance between the lower sections 13, 22 is shorter and the angle in upright position is small. When the chain 23 is positioned at the fixing holes 221. The angle in upright position is the largest. For folding of the file, the chain 23 is fastened to the fixing holes 223 at the lateral side of the outer covering board 2, as shown in FIG. 10.

While the invention has been described with respect to preferred embodiment, it will be clear to those skilled in the art that modifications and improvements may be made to the invention without departing from the spirit and scope of the invention. Therefore, the invention is not to be limited by the specific illustrative embodiment, but only by the scope of the appended claims.

We claim:

1. A structure of a file with adjustable inclination angle comprising (a) an inner covering board having a rear center; (b) an outer covering board mounted to the upper section of the inner covering board at one surface thereof and a scored line being formed across the outer covering board so that the outer covering board can be inclined at an angle with respect to the inner covering board, a bottom edge of the outer covering board being provided with a plurality of fixing holes; (c) a pair of chains having a stop at both ends and one of the stops being fastened to a lower section of the inner covering board and the other stop being mounted to the fixing holes at a lower section of the outer covering board, thereby when the outer covering board is extended with an inclination angle, the chain is touted by a weight of the file and the file is stood in a stable inclined position.

2. The structure as set forth in claim 1, wherein the rear center of the outer covering board is provided with a flexural section with a through hole at the center thereof.

3. The structure as set forth in claim 1, wherein the rear center of the inner covering board is provided with a flexural section.

* * * * *